US006260619B1

(12) United States Patent
Svedeman et al.

(10) Patent No.: US 6,260,619 B1
(45) Date of Patent: Jul. 17, 2001

(54) OIL AND GAS PRODUCTION WITH DOWNHOLE SEPARATION AND COMPRESSION OF GAS

(75) Inventors: Steven J. Svedeman; Steven P. Petullo, both of San Antonio, TX (US); John M. Klein, Anchorage; James L. Cawvey, Anchorage; Jerry L. Brady, Anchorage; Mark D. Stevenson, Anchorage, all of AK (US)

(73) Assignee: Atlantic Richfield Company, Plano, TX (US)

( * ) Notice: Subject to any disclaimer, the term of this patent is extended or adjusted under 35 U.S.C. 154(b) by 0 days.

(21) Appl. No.: 09/351,483

(22) Filed: Jul. 13, 1999

(51) Int. Cl.[7] ..... E21B 43/40

(52) U.S. Cl. ..... 166/265; 166/105.5; 166/306; 166/369

(58) Field of Search ..... 166/265, 266, 166/306, 105.5, 169, 369, 370

(56) References Cited

U.S. PATENT DOCUMENTS

| | | | | |
|---|---|---|---|---|
| 4,088,459 | * | 5/1978 | Tuzson | 55/203 |
| 4,531,593 | | 7/1985 | Elliott et al. . | |
| 4,981,175 | | 1/1991 | Powers . | |
| 5,431,228 | | 7/1995 | Weingarten et al. . | |
| 5,482,117 | | 1/1996 | Kolpak et al. . | |
| 5,605,193 | | 2/1997 | Bearden et al. . | |
| 5,730,871 | | 3/1998 | Kennedy et al. . | |
| 5,794,697 | | 8/1998 | Wolflick et al. . | |

* cited by examiner

*Primary Examiner*—William Neuder
*Assistant Examiner*—Zakiya Walker
(74) *Attorney, Agent, or Firm*—Drude Faulconer

(57) ABSTRACT

A method and system for producing a mixed gas-oil stream through a tubing wherein at least a portion of the gas is separated from the stream and flowed through a restriction in the tubing to cool the separated gas and reduce its pressure to thereby retain larger amounts of liquid (i.e. condensate) in the gas-oil stream which is to be produced to the surface. The separated gas is compressed downhole before it is injected into a downhole formation.

10 Claims, 2 Drawing Sheets

OIL AND GAS PRODUCTION WITH DOWNHOLE SEPARATION AND COMPRESSION OF GAS

DESCRIPTION

1. Technical Field

The present invention relates to separating and compressing a portion of the gas from the oil-gas stream produced from a subterranean zone and reinjecting the compressed gas downhole without producing the compressed gas to the surface and in one aspect relates to a method and downhole or subsurface system for separating a portion of the gas from a gas-oil production stream, passing the remainder of the production stream through a turbine to drive a compressor which, in turn, compresses the separated gas, and then injecting the compressed gas into a downhole formation while allowing substantial amounts of condensate to be recovered to the surface along with the remaining production stream.

2. Background

It is well known that many hydrocarbon reservoirs produce extremely large volumes of gas along with crude oil and other formation fluids, e.g. water. In producing fields such as these, it is not unusual to experience gas-to-oil ratios (GOR) as high as 25,000 standard cubic feet per barrel (scf/bbl.) or greater. As a result, large volumes of gas must be separated out of the liquids before the liquids are transported to storage for further processing or use. Where the production sites are near or convenient to large markets, this gas is considered a valuable asset when demands for gas are high. However, when demands are low or when a producing reservoir is located in a remote area, large volumes of produced gas can present major problems since production may have to be shut-in or at least drastically reduced if the produced gas can not be timely and properly disposed of.

In areas where substantial volumes of the produced gas can not be marketed or otherwise utilized, it is common to "reinject" the gas into a suitable, subterranean formation. For example, it is well known to inject the gas back into a "gas cap" zone which often overlies a production zone of a reservoir to maintain the pressure within the reservoir and thereby increase the ultimate liquid recovery therefrom. In other applications, the gas may be injected into a producing formation through an injection well to drive the hydrocarbons ahead of the gas towards a production well. Still further, the produced gas may be injected and "stored"in an appropriate, subterranean permeable formation from which it can be recovered later when the situation dictates.

To reinject the gas, large and expensive separation and compression surface facilities must be built at or near the production site. A major economic consideration in such facilities is the relatively high cost of the gas compressor train which is needed to compress and raise the large volumes of produced gas to the pressures required for reinjection. As will be understood in this art, significant cost savings can be achieved if these gas compressor requirements can be down-sized or eliminated altogether. To achieve this, however, it is necessary to either raise the pressure of the gas at the surface by some means other than mechanical compression or else reduce the pressure required at the surface for reinjection of the gas downhole or reduce the volume of gas actually produced to the surface.

Various methods and systems have been proposed for reducing some of the separating/handling steps normally required at the surface to process and/or re-inject at least a portion of the produced gas. These methods all basically involve separating at least a portion of the produced gas from the production stream downhole and then handling the separated gas and the remainder of the production stream separately from each other.

For example, one such method involves the positioning of an "auger" separator downhole within a production wellbore for separating a portion of the gas from the production stream as the stream flows upward through the wellbore; see U.S. Pat. No. 5,431,228, issued Jul. 11, 1998. Both the remainder of the production stream and the separated gas are flowed to the surface through separate flowpaths where each is individually handled. While this downhole separation of gas reduces the amount of separation which would otherwise be required at the surface, the gas which is separated downhole still requires substantially the same amount of compressor horsepower at the surface to process/reinject the gas as that which would be required if all of the gas in the production stream had been separated at the surface.

Another system involving the downhole separation of gas from a production stream is fully disclosed and claimed in U.S. Pat. No. 5,794,697, issued Aug. 18, 1998 wherein a subsurface processing and reinjection compressor (SPARC) is positioned downhole in the wellbore. The SPARC includes an auger separator which first separates at least a portion of the gas from the production stream (i.e. approximately half) and then compresses the separated gas by passing it through a compressor which, in turn, is driven by a turbine.

The remainder of the production stream (i.e. approximately the other half of the gas and the liquids) is routed through the turbine to act as the power fluid for driving the turbine. The compressed gas is not produced to the surface but instead is injected directly from the compressor into a second formation (e.g. gas cap) within the production wellbore. The system is designed to maintain as much pressure on the separated gas as possible and thereby inject as much gas as possible in the downhole formation. While this system may separate and reinject up to about half of the gas in the production stream, it recovers very little of the desirable condensate that is present in the re-injected gas.

Another system utilizing a SPARC, positioned downhole within a production well, is disclosed in co-pending and commonly-assigned, U.S. patent application, Ser. No. 09/282,056, filed Mar. 29, 1999. In this system, the SPARC separates and compresses a portion of the gas in the production stream basically in the same manner as described above, but instead of re-injecting the compressed gas, both the compressed gas and the remainder of the production stream are produced to the surface through separate flowpaths.

Still another similar system is disclosed in co-pending and commonly-assigned, U.S. patent application, Ser. No. 09/028,624, filed Feb. 24, 1998, now U.S. Pat. No. 6,035,934. In this downhole separation system, the entire production stream is first flowed through the turbine to drive same before the stream is flowed through an auger separator which, in turn, is positioned above the turbine. A portion of the gas in the production is then separated by the auger and is passed through a compressor which, in turn, is driven by the turbine. The compressed gas is then injected into a formation adjacent the wellbore. While this system recovers a significant amount of the desirable condensate in the production stream, substantially less gas from the production stream is likely to be injected downhole.

Accordingly, it is desirable to separate a significant amount of the gas from the production stream while at the same time being able to recover to the surface a significant portion of the condensates from the re-injected gas.

SUMMARY OF THE INVENTION

The present invention provides a method and system for producing a mixed gas-oil stream to the surface from a subterranean zone through a wellbore wherein at least a portion of said gas is separated from said mixed gas-oil stream downhole and is compressed to increase the pressure of the separated gas before the compressed gas is re-injected into a formation adjacent the wellbore. As will be understood in the art, the production stream will normally also include some water which will be produced with the oil and as used herein, "mixed gas-oil stream(s)" is intended to include streams which also may include produced water along with the gas and oil.

In the present invention, the mixed gas-oil stream flows upward through a string of production tubing and through a downhole separator such as an auger which causes the fluids to rotate with the heavier liquid components moving outward toward the tubing wall. The remaining stream, i.e. gaseous fluids, then flow upward through a restriction in the tubing whereby the resulting increase in velocity of the streams causes a reduction in both the temperature and pressure of the gas stream. By reducing the temperature and pressure of the gas stream, more of the desire liquid (i.e. condensate) is formed and removed from the gas stream by the centrifugal forces imparted by the auger separator. It follows that less condensate will remain in its gaseous state to be compressed and re-injected downhole. After the streams have flowed through the restriction, the separated portion of the gas is flowed through a first diffuser within said wellbore to thereby recover at least a portion of reduced pressure of said separated portion of said gas and the remaining mixed gas-oil stream is flowed through a second diffuser to thereby recover at least a portion of said reduced pressure of said mixed gas-oil stream. The separated portion of the gas is then compressed downhole and is injected into a formation adjacent said wellbore.

More specifically, the present system for producing a mixed gas-oil stream from a subterranean zone is comprised of a string of tubing extending from the subterranean zone to the surface. A separator (e.g. auger separator) is positioned within the tubing and is adapted to separate at least a portion of said gas from said gas-oil stream as said stream flows upward through said tubing. A restrictive passage is positioned within the tubing above the separator through which both the separated portion of said gas and the remaining mixed gas-oil stream flows. The velocity of these streams increase as they flow through the restrictive passage which results in a reduction in both the temperature and pressure of the separated gas stream thereby causing additional liquid to condense (i.e. condensate) from the gas stream. The rotation imparted by the auger separator causes the heavier liquid to be separated to the outside of the flow passage. Accordingly, the condensate is removed from that portion of the gas which flows to the compressor.

The separated gas then flows through a first diffuser into the inlet of a compressor which is positioned within the tubing above the restrictive passage. The first diffuser is comprised of a divergent tube which is connected at one end to the inlet of said compressor and which terminates at its other end substantially adjacent the exit end of the restrictive passage.

The remaining mixed gas-oil stream flows through a second diffuser into the inlet of a turbine which is positioned within the tubing above the compressor. The second diffuser is comprised of a divergent portion within said tubing which extends between the exit end of the restrictive passage and the inlet of said turbine. As the streams flow through the respective diffusers, a portion of the pressure which was lost by the respective streams, as they flowed through the restrictive passage, is recovered. The remaining mixed gas-oil stream flows from the second diffuser into the turbine to power the turbine which, in turn, drives the compressor to compress and inject the separated gas.

BRIEF DESCRIPTION OF THE DRAWINGS

The actual construction, operation, and apparent advantages of the present invention will be better understood by referring to the drawings which is not necessarily to scale and in which like numerals refer to like parts and in which.

BEST KNOWN MODE FOR CARRYING OUT THE INVENTION

Figure 1:
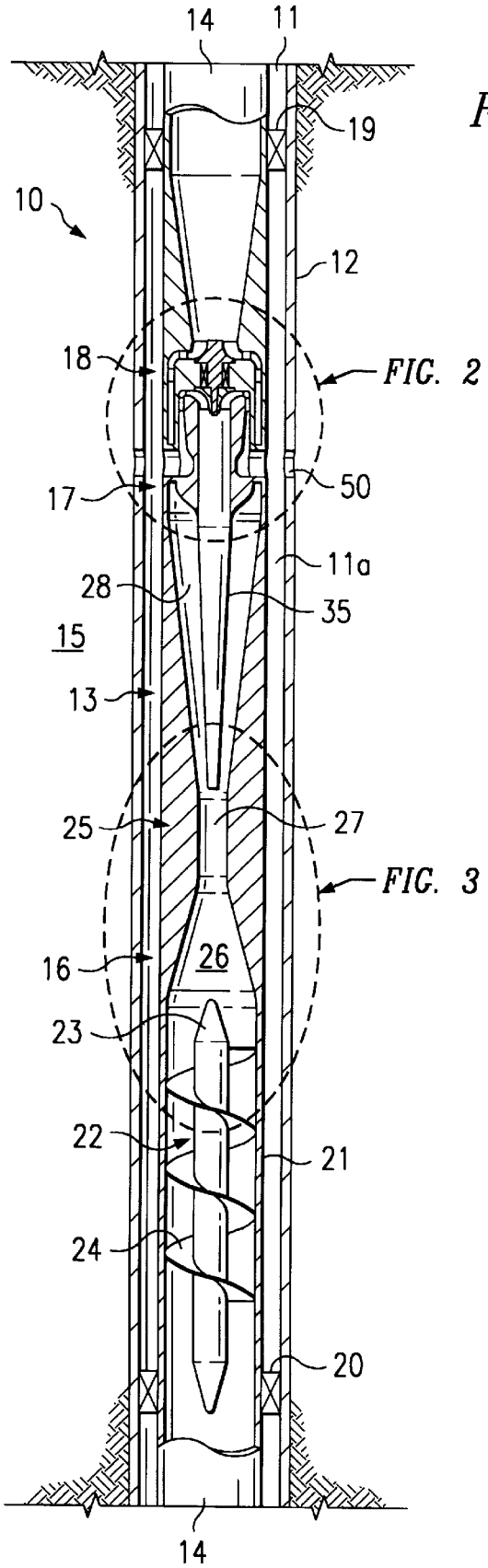
FIG. 1 is a cross-sectional view, partly broken away, of the subsurface separator-compressor system of the present invention when in an operable position within a production wellbore.

Referring more particularly to the drawings, FIG. 1 discloses a downhole section of production well 10 having a wellbore 11 which extends from the surface into and/or through a production zone (neither shown). As illustrated in FIG. 1, wellbore 11 is cased with a string of casing 12 which is perforated or otherwise completed (not shown) adjacent the production zone to allow flow of fluids from the production zone into the wellbore as will be fully understood by those skilled in the art.

While the subsurface processing and reinjection compressor system 13 of the present invention may be assembled into a string of production tubing 14 and lowered therewith into the wellbore 11 to a position adjacent formation 15 (e.g. a gas cap above a production formation), preferably it is lowered through the production tubing 14 by a wireline, coiled tubing string, etc. after the production tubing has been run into the wellbore 11. System 13 is basically comprised of three major components; separator section 16, compressor section 17, and turbine section 18. Packers 19, 20 are spaced between system 13 and casing 12 for a purpose described below.

Figure 3:
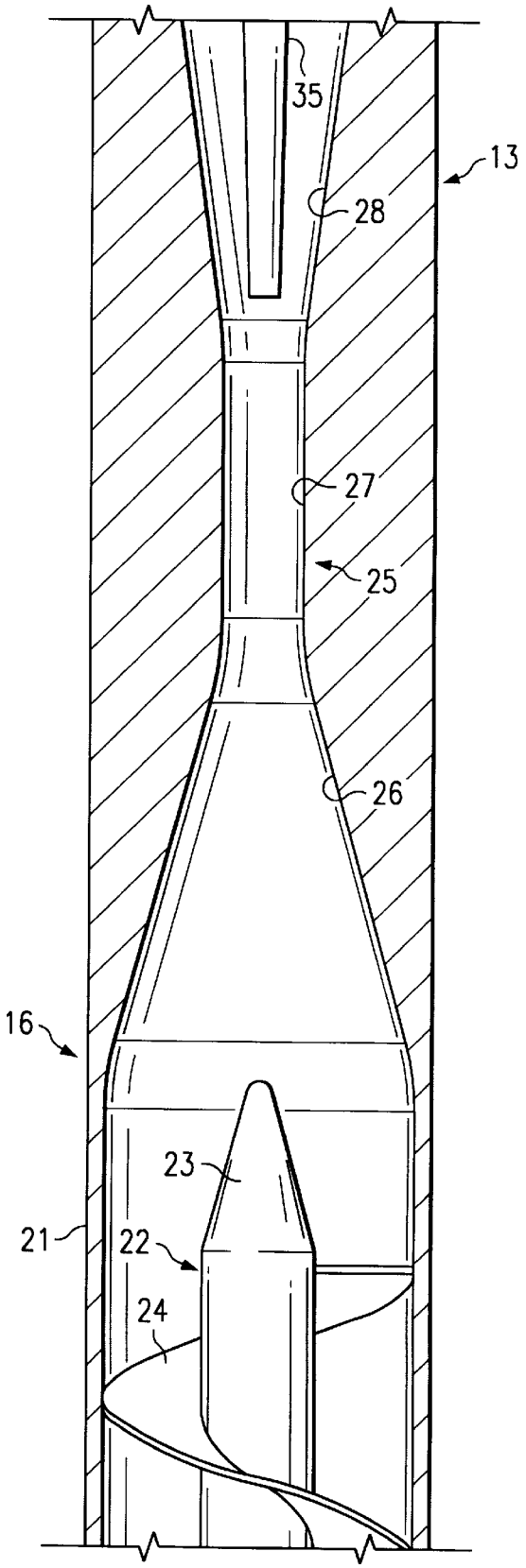
FIG. 3 is an enlarged, cross-sectional view of the present subsurface separator-compressor system taken within line 3—3 of FIG. 1.

Referring now to FIGS. 1 and 3, sections 16, 17, and 18 can be housed in a single housing 21, as shown, or each section can be formed in a separate sub of a relative short length which, in turn, are coupled together by threads or the like (not shown). Separator section 16 is formed in the lower end of housing 21 which, in turn, is connected at its lower end into production tubing string 14 to receive the flow of the production stream as it flows upward through the tubing.

Separator section 16 is comprised of an auger separator 22 which is positioned within the housing 21 and is adapted to impart a spin on the production stream as it flows therethrough for a purpose to be described later. As shown, auger separator 22 is comprised of a central rod 23 having a helical-wound, auger-like flight 24 secured thereto.

Auger separators of this type are known in the art and are disclosed and fully discussed in U.S. Pat. No. 5,431,228 which issued Jul. 11, 1995, and which is incorporated herein in its entirety by reference. Also, for a further discussion of the construction and operation of such separators, see "New Design for Compact-Liquid Gas Partial Separation: Down Hole and Surface Installations for Artificial Lift Applications", Jean S. Weingarten et al, SPE 30637, presented Oct. 22–25, 1995 at Dallas, Tex.

Also forming a part of separator section 16 is a throat or restriction section 25 which lies within housing 21 above separator 22, the purpose of which will also be described below. Throat section 25 is comprised basically of a converging inlet portion 26, a restrictive flow passage 27, and a diverging outlet portion 28 as shown in FIGS. 1 and 3.

Compressor section 17 and turbine section 18 are positioned within housing 21 above separator section 16 as shown in the figures. Compressor section 17 is comprised of an inlet 29, rotary vanes 30, and an outlet(s) 31. Turbine section 18 is comprised of an inlet(s) 32, rotary vanes 33, stationary vanes 33*a,* and an outlet 34. As will be understood, as a power fluid flows through turbine section 18, it will rotate vanes 33 which, in turn, rotate vanes 30 in compressor section 17 to thereby compress gas flowing therethrough. A first diffuser 35 is comprised of an elongated, downwardly-tapered tube 35 which has one end connected to inlet 29 of compressor section 17 and its other end terminating substantially at the exit end of restrictive passage 27.

In operation, a mixed gas-oil stream from a subterranean, production zone (not shown) flows upward to the surface (not shown) through production tubing 14. As will be understood in the art, most mixed oil-gas streams will also include some produced water so as used herein, "mixed oil-gas stream" is intended also to include streams having some produced water therein.

As the mixed gas-oil stream flows upward through separator section 16, auger flight 24 of auger separator 22 will impart a spin on the stream wherein the liquids (e.g. oil, water, etc.) in the stream are forced to the outside of the auger by centrifugal force while at least a portion of the gas is separated from the stream and remains near the wall of center shaft 23. As the stream reaches the end of flight 24, it flows through the convergent portion 26 of throat 25 and into restrictive passage 27. The velocity of both the gas stream and the remaining gas-oil stream increase as they flow through the restrictive passage 27. This increased velocity causes a reduction in both the static pressure and the temperature of the separated gas stream due to the conservation of energy. The colder temperature and lower pressure of the gas stream result in larger amounts of liquid condensing and separating into the remaining mixed gas-oil stream, which, in turn, is ultimately produced to the surface.

Figure 2:
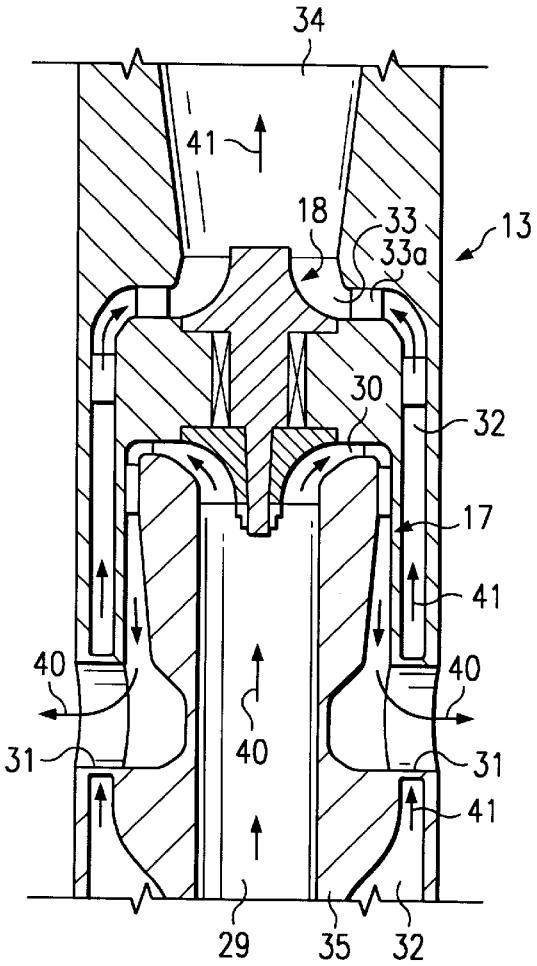
FIG. 2 is an enlarged, cross-sectional view of the present subsurface separator-compressor system taken within line 2—2 of FIG. 1.

As the production stream flows out the exit end of passage 27, the center of the stream will now be comprised mainly of gas (arrows 40 in FIG. 2) which then flows into the open end of the first diffuser (i.e. tapered tube 35) and into inlet 29 of compressor section 17. This first diffuser is designed to recover from about 50% to about 70% of the pressure that was lost by the gas stream when it flowed through the restrictive passage 27. The outer portion of the production stream or the remaining mixed gas-oil stream will be comprised of the liquids (including the increased condensate) and remaining gas (arrows 41 in FIG. 2).

This remaining gas-oil stream will flow along the outside of tube 35 and into the inlet(s) 32 of turbine section 18 to power the turbine to thereby drive the compressor. The diverging section 28 of separator section 16 functions as a second diffuser which recovers about 50% of the pressure lost by the remaining gas-oil stream when it flowed through restrictive passage 27. Remaining stream 41 will recover less pressure than gas stream 40 since stream 41 contains substantial amounts of both liquid and gas while gas stream 40 is primarily comprised of gas.

Remaining stream 41 flows through inlet(s) 32 of turbine section 18 to rotate vanes 33 which, in turn, rotate vanes 30 in compressor section 17. As gas stream 40 flows through inlet 29 and into compressor section 17, it is compressed before it exits through outlet(s) 31. The compressed gas then flows into the space isolated between packers 19, 20 in annulus 11*a* and from there is injected into formation 15 through openings 50 (e.g. perforations) in casing 12.

Without being restrictive in any way, the following example is offered to illustrate the present invention. A production stream having a flow rate of about 1200 barrels/day and at a temperature of 200° F. and a pressure of 2450 psia is flowed up through production tubing 14 and into auger separator section 16 of the system of the present invention. As the stream passes through auger separator section 16, a portion of the gas (e.g. 37%) is separated and remains near the center of the flowpath.

The velocity of the stream enters restrictive passage 27 and is increased to 400 ft/sec.. This increase in velocity will reduce the temperature and the pressure of the gas stream from about 199° F. and 2390 psia to about 189° F. and about 2200 psia, respectively. The separated gas, which is to be compressed and injected downhole, will be approximately 37% of the gas in the original production stream while the percentage of liquid (i.e. condensate) will be increased by approximately 3% over that would otherwise be expected to be recovered using prior art, downhole systems of this type.

What is claimed is:

1. A method for producing a mixed gas-oil stream to the surface from a subterranean zone through a wellbore wherein said mixed gas-oil stream also contains an amount of condensate; said method comprising:

separating at least a portion of the gas from said mixed gas-oil stream downhole as said mixed stream flows upward through said wellbore;

flowing both the separated portion of said gas and the remaining mixed gas-oil stream through a common restriction within said wellbore to increase the velocity thereof to thereby reduce the temperature and pressure of said separated portion of said gas to thereby increase said amount of condensate which remains in said remaining mixed gas-oil stream;

flowing said remaining mixed gas-oil stream through a diffuser within said wellbore after said remaining mixed gas-oil stream has flowed through said common restriction in said wellbore to thereby increase at least a portion of said reduced pressure of said remaining mixed gas-oil stream; and flowing said remaining mixed gas-oil stream with said increased condensate therein to the surface.

2. The method of claim 1 including:

flowing said separated portion of said gas through another diffuser within said wellbore after said separated portion of said gas has passed through said restriction in said wellbore to thereby recover at least a portion of said reduced pressure of said separated portion of said gas.

3. The method of claim 1 including:

compressing said separated portion of said gas downhole after it has passed through said restriction; and injecting said compressed gas into a formation adjacent said wellbore.

4. The method of claim 3 wherein said separating, compressing, and injecting of said gas is carried out by using a downhole processing and reinjecting compressor system.

5. A system for producing a mixed gas-oil stream from a subterranean zone to the surface through a wellbore said system comprising:

a string of tubing positioned within said wellbore and exending from said subterranean zone to said surface wherein an annulus is formed between said tubing and said wellbore;

a separator positioned downhole within said tubing and adapted to separate at least a portion of said gas from said gas-oil stream as said stream flows upward through said tubing;

a throat section having a restrictive passage in said tubing above said separator, said restrictive passage having an inlet and an outlet, said inlet adapted to receive both said separated portion of said gas and the remaining mixed gas-oil stream whereby both said separated portion of said gas and said remaining mixed gas-oil streams flows through said restrictive passage;

a compressor positioned downhole within said tubing and having an inlet adapted to receive said separated gas from said outlet of said restrictive passage to compress said separated portion of said gas; and a turbine positioned downhole within said tubing for driving said compressor, said turbine having an inlet and an outlet, said inlet adapted to receive said remaining mixed gas-oil stream from said outlet of said restrictive passage for rotating said turbine and driving said compressor and said outlet of said compressor being in fluid communication with said tubing whereby said remaining mixed gas-oil stream is produced through said tubing to the surface after said remaining mixed gas-oil stream has passed through said turbine.

6. The system of claim 5 wherein said separator is an auger separator.

7. The system of claim 5 including:

a first diffuser within said tubing and fluidly connected to said inlet of said compressor whereby said separated portion of said gas flows from said restrictive passage, through said first diffuser, and into said compressor.

8. The system of claims 7 including:

a second diffuser fluidly connected to said inlet of said turbine whereby said remaining mixed gas-oil stream flows from said restrictive passage, through said second diffuser, and into said turbine.

9. The system of claim 8 wherein said first diffuser comprises:

a divergent tube connected at one end to said inlet of said compressor and terminating substantially adjacent said outlet of said restrictive passage.

10. The system of claim 9 wherein said second diffuser comprises:

a divergent portion within said tubing extending substantially from said exit end of said restrictive passage to said inlet of said turbine.

* * * * *